US009570837B2

(12) United States Patent
Rauer

(10) Patent No.: US 9,570,837 B2
(45) Date of Patent: Feb. 14, 2017

(54) CONNECTOR PLUG FOR INSERTION INTO A SOCKET

(71) Applicant: Erich Jaeger GmbH & Co. KG, Friedberg (DE)

(72) Inventor: Timm Rauer, Giessen (DE)

(73) Assignee: Erich Jaeger GmbH & Co. KG, Friedberg (DE)

( * ) Notice: Subject to any disclaimer, the term of this patent is extended or adjusted under 35 U.S.C. 154(b) by 0 days.

(21) Appl. No.: 14/950,984

(22) Filed: Nov. 24, 2015

(65) Prior Publication Data

US 2016/0181721 A1 Jun. 23, 2016

(30) Foreign Application Priority Data

Nov. 27, 2014 (DE) ..... 20 2014 105 733 U

(51) Int. Cl.

| | |
|---|---|
| ***H01R 13/622*** | (2006.01) |
| ***H01R 13/512*** | (2006.01) |
| ***H01R 13/508*** | (2006.01) |
| ***H01R 13/426*** | (2006.01) |
| *H01R 13/639* | (2006.01) |

(52) U.S. Cl.

CPC ..... *H01R 13/512* (2013.01); *H01R 13/426* (2013.01); *H01R 13/508* (2013.01); *H01R 13/639* (2013.01)

(58) Field of Classification Search

CPC ... H01R 13/622; H01R 13/621; H01R 13/639; H01R 2103/00; H01R 2201/26

USPC ..... 439/34, 35, 320, 321, 322

See application file for complete search history.

(56) References Cited

U.S. PATENT DOCUMENTS

| | | | | |
|---|---|---|---|---|
| 4,310,213 | A * | 1/1982 | Fetterolf, Sr. | H01R 13/516 439/320 |
| 4,521,066 | A * | 6/1985 | Kempe | H01R 13/623 439/320 |
| 5,378,882 | A * | 1/1995 | Gong | G06K 7/10881 235/462.45 |
| 6,368,133 | B1 | 4/2002 | Zeiler et al. | |
| 6,827,597 | B1 * | 12/2004 | Metzbower | H01R 13/502 439/320 |

(Continued)

FOREIGN PATENT DOCUMENTS

| | | |
|---|---|---|
| DE | 3730033 A1 | 3/1989 |
| DE | 8815093.3 U1 | 3/1989 |

(Continued)

*Primary Examiner* — Hien Vu

(74) *Attorney, Agent, or Firm* — McDonnell Boehnen Hulbert & Berghoff LLP

(57) ABSTRACT

A connector plug for insertion into a socket. The connector plug having a multipart housing comprising a front part and a rear part. The front part and the rear part are affixed to each other by means of being screwed together by a thread. The front part and the rear part a groove is formed respectively. The two grooves extend in axial direction at the outer circumference of the front part and the rear part and are aligned relative to each other when the front part and the rear part are screwed together completely. A slider can be housed by an adapter at the front part or the rear part whereby the slider has a crosspiece that engages with the groove and when the front part and the rear part are screwed together completely it can be displaced into a locked position.

10 Claims, 2 Drawing Sheets

(56) References Cited

U.S. PATENT DOCUMENTS 7,140,898 B2 * 11/2006 Sanuki ..... H01R 13/502
439/314

FOREIGN PATENT DOCUMENTS

| | | | |
|---|---|---|---|
| DE | 10056888 | A1 | 6/2001 |
| DE | 20205806 | U1 | 8/2003 |
| DE | 202006001884 | U1 | 6/2007 |
| EP | 0822618 | A1 | 2/1998 |

* cited by examiner

CONNECTOR PLUG FOR INSERTION INTO A SOCKET

CROSS REFERENCE TO RELATED APPLICATIONS

The present application claims the benefit of German Patent Application No. 20 2014 105 733.1 filed Nov. 27, 2014 the entire contents of which are incorporated entirely herein by reference.

The invention relates to a connector plug for insertion into a socket, in particular, for connecting an attachment and/or trailer to a vehicle, preferably according to the ISOBUS standard. The ISOBUS standard is used, in particular, in agriculture and/or in the area of freight vehicles. Tractors with equipment that is supplied with voltage and/or control signals are a frequent application.

The connector plug is constructed consisting of a multi-part housing that has a front part of the housing and a rear part of the housing, whereby the front part of the housing and the rear part of the housing are affixed to each other by a thread that is screwed together. The front part of the housing can, for example, form the contact area for the connection with the socket, and the rear part of the housing, for example, can have the connection area for the connecting cable that is conductively connected with the contact area. Thus, the connection area serves the purpose of connecting the contacts of the connector plug with the connecting cable and/or to position the contacts affixed to the connecting cable in the front part of the housing, and/or the contact area in the front part of the housing. If applicable, a contact insert can also be housed in the front part of the housing and/or the rear part of the housing that bears the contacts and is positioned in the front part of the housing. As a result of screwing the front part of the housing and the rear part of the housing together, the contacts in the connector plug are fixed and/or secured in their designated position.

In particular, the front part of the housing is thus designed in such a way that the shape of the front part of the housing and the arrangement of the contacts in the front part of the housing are adapted to the socket in order to connect a contact area of the connector plug with a contact area of the socket. Most of the time, the shape of the front part of the housing and the arrangement of the contacts in the front part of the housing are, in this respect, specified by a corresponding standard.

The two-piece housing offers the advantage that the connecting line of the connector plug can be interchanged at any time by separating the front part of the housing and the rear part of the housing of the connector plug.

Contacts provided in the housing of the socket are thereby accessible and can be connected or separated from the connecting line. For this purpose, the connecting line is inserted into the rear part of the housing through a connecting aperture of the housing that is located in the rear part of the housing. Individual conductors of the connecting line can then be connected with the contacts in known ways, for example, by being screwed together, crimped, soldered or the like. The contacts are affixed in the front part of the housing or can be inserted or moved into such for positioning in the contact area.

It is also possible to insert contacts firmly connected with the connecting line, for example, by crimping, soldering or the like of the electrically conducting connection into the housing through the rear part of the housing, for example, through the connecting aperture of the housing, position the contacts in the front part of the housing and then close the housing by screwing together the front part of the housing and the rear part of the housing.

A separate contact insert can also be inserted into the housing that then specifies the contact arrangement in the front part of the housing. Preferably, the contact insert is fixed in the housing by screwing the front part of the housing together with the rear part of the housing. The contacts in the contact insert can be connected with the connecting line as prescribed.

Regardless of the precise manner of contact by the connecting lines and the contacts in the connector plug which is not the subject matter of the present invention, there is a need, in particular, for establishing such a contact, to make the contact area of the connector plug accessible.

For this purpose, the thread is provided for screwing together the front part of the housing and the rear part of the housing. The thread consists of an outer thread at one housing part, for example, the front part of the housing, and an inner thread at the other part of the housing, for example, the rear part of the housing.

In particular, as the internal space enclosed by the front part of the housing and the rear part of the housing also includes the contact area, the front part of the housing and the rear part of the housing are preferably sealed with a seal against the ingression of moisture by means of sealing surfaces at the front part of the housing and the rear part of the housing when the front part of the housing and the rear part of the housing are affixed to each other by being screwed together completely. This is indispensable corresponding to the ISOBUS standard for connector plugs that are used outdoors, for example, for vehicles or agricultural machinery.

In practice, connector plugs of this type have the problem that the screw-fastening between the front part of the housing and the rear part of the housing can loosen upon being inserted into the socket. This is fostered thereby, that frequently, a bayonet lock is provided, (for example, in the form of a rotatable bayonet ring located at the outer circumference of the front part of the housing that is rotated during the insertion of the connector plug into a socket to secure the plug connection). Thereby, the screw connection between the front part of the housing and the rear part of the housing can also unintentionally become partially loose.

This can lead to an ingression of moisture when the seal between the front part of the housing and the rear part of the housing no longer abuts at the sealing surfaces completely, or contaminations (such sand grains or similar small particles) reach the sealing surface. Sometimes, even contacts are no longer positioned in the intended position in the front part of the housing, in particular, when this positioning is achieved or secured by screwing together the front part of the housing and the rear part of the housing. This can also lead to contact problems all the way to sparks or (due to poor contacting) increased temperature development. In particular, this applies given the background that frequently, consumption units with high voltage consumption are connected to the ISOBUS connector plug that is particularly affected by the invention such as, for example, agricultural machinery and refrigeration units of trucks.

It is therefore the objective of the present invention to secure the connection of the front part of the housing and the rear part of the housing for the type of connector plugs previously described.

This problem is solved by the features of claim 1. Thereby, it is provided that a groove is formed in the front part of the housing and the rear part of the housing respectively, whereby the two grooves in the front part of the housing and the rear part of the housing extend in axial direction at the outer circumference of the front part of the housing and the rear part of the housing. In particular, the axial direction can be defined by the plug direction of the connector plug and/or its longitudinal axis. When the front part of the housing and the rear part of the housing are screwed together completely, the two groves are aligned with each other, i.e. they complement each other—in other words—they form a common groove.

Further, according to the invention, a slider can be housed in an adapter on the front part of the housing or on the rear part of the housing, whereby the slider has a crosspiece that engages with the groove and when the front part of the housing and the rear part of the housing are screwed together completely, it can be displaced into a locked position in which the crosspiece of the slider engages with the groove of both housing parts, the front part of the housing and the rear part of the housing. In the adapter of one housing part, the slider must be blocked against displacement and/or rotation out of the locked position in order to secure the locked position.

In a simple embodiment, the slider can be designed as a type of catch that is fixed captive at the adapter of the front part of the housing or the rear part of the housing and can be displaced in the groove between a release position and a locked position, whereby the crosspiece of the slider engages in the groove of only one of the two housing parts, the rear part of the housing or the front part of the housing in the release position, preferably engaging with the groove of the housing part that is provided with the adapter, and in the locked position, engages in the groove of both housing parts, the rear part of the housing and the front part of the housing. In the locked position, the slider can be blocked against a displacement out of the locked position by means of a catch mechanism relative to one and/or the other housing part.

In particular, the condition in which the front part of the housing and the rear part of the housing are screwed together completely can be defined thereby, that at end of the outer thread that is opposite to the free end of the outer thread (i.e. at that housing part, in particular, the end of the outer thread that is facing the front part of the housing) a radially protruding edge is formed relative to the central axis of the thread. This protruding edge works together with the edge of the housing aperture in which the inner thread of the other housing part is formed, in particular, the rear part of the housing. The protruding edge and the edge of the housing aperture work together when the front part of the housing and the rear part of the housing are being screwed together thereby, that the edge of the housing aperture strikes against the protruding edge and prevents further screwing. Hereby, the path of screw insertion is delimited.

An important feature of the preferred delimitation of the path of screw insertion according to the invention, as it is described above is, that the front part of the housing and the rear part of the housing are in a defined directional position relative to each other when they are screwed together completely due to the limitation of the path of screw insertion, for example, by means of a stop. The condition of being screwed together completely has been reached then, when the limit of the path of screw insertion takes effect. Hereby, it is ensured, among other things, that the two grooves in the front part of the housing and the rear part of the housing are aligned relative to each other in the condition in which the front part of the housing and the rear part of the housing are screwed together completely.

According to a preferred embodiment, the adapter for the slider is formed on the rear part of the housing. This is expedient because the slider is thus retained at the rear part of the housing and can be actuated easier. The rear part of the housing offers more scope for design as it does not need to be adapted to the shape of the socket as is the case for the front part of the housing.

Preferably, the adapter can have two plates that protrude upward—parallel to the lateral walls of the groove—opposite each other from the outer circumference of the rear part of the housing. Guide tracks are provided on both plates that work together with the guide elements of the slider and prevent that the slider falls off in radial direction from the rear part of the housing.

Thereby, the slider can be secured against falling off in the adapter. Due to the guiding, easy handling is achieved upon actuating the slider. Preferably, the guide elements of the slider can also have corresponding tracks so that for guidance, the guide tracks of the plates and the tracks of the guide elements slide alongside each other extending over an extended section. This ensures effortless guidance.

Preferably, the two plates are located laterally, aligned with the lateral walls of the groove, whereby each plate is aligned with a lateral wall of the groove. Within this meaning, those elements of the connector plug count as plates that are formed at the lateral wall of the groove along these lateral walls, project upward from the exterior circumference of the rear part of the connector plug and are designed in such a way that the crosspieces of the slider can run alongside such. In this embodiment, the guide tracks are preferably located on the sides of the plates facing away from each other. The crosspiece then securely abuts at the plates so that the alignment of the slider in the groove is secured particularly reliably and the slider does not tilt or rotate at the rear part of the housing.

In an alternative embodiment according to the invention, the plates can also be laterally offset to the edge of the groove of the rear part of the housing, whereby the guide tracks are located on the sides of the plates facing each other and work together with the guide elements provided at the crosspiece of the slider. Aside from this configuration of the plates, guide elements and tracks are the remaining features of the invention as they are described within the scope of this entire disclosure, that are likewise jointly or individually realizable by the person skilled in the art within the scope of his specialized skills.

Especially preferred according to the invention, the guide tracks can be located on both plates, preferably aslant in the same way so that they have a larger distance to the exterior circumference of the rear part of the housing at their one end than at their other end. Relative to a plane coinciding with the surface of the plates, the guide tracks are thus preferably located in mirror image. This has the effect that the distances of the guide tracks on both plates are equal at both ends relative to the axial direction of the connector plug.

Thereby, the distance of the guide tracks to the exterior circumference of the rear part of the housing at the edge of the plates facing the front part of the housing is, in particular, smaller than on the end of the plates facing away from the front part of the housing. Upon traversing from a release position into the locked position, the slider is then not only pushed in the direction of the front part of the housing, but it is thereby also lowered, i.e. guided in the direction of the central axis of the connector plug. As a result, the crosspiece is immersed deeper into the groove (of the front part of the housing as well as the rear part of the housing) and increases the reliability of the lock. Conversely, the unlocking can take place as the result of the combined adjustment in the longitudinal direction of the groove, i.e. in axial direction of the Steckher, and in radial direction of the connector plug, i.e. away from the exterior circumference of the housing. However, this is not absolutely necessary.

In this connection it is even possible to design the grooves in the front part of the housing and the rear part of the housing of different depths, whereby the groove in the front part of the housing is then preferably deeper than that in the rear part of the housing. As the result of this optional feature, the part of the crosspiece that engages with the front part of the housing can engage especially deep in the groove of the front part of the housing and thus secure it especially reliably against any rotation relative to the rear part of the housing.

Regardless of any varying depth of the groove in the front part of the housing and the rear part of the housing, the crosspiece—according to a preferred embodiment of the invention—can have a rigid, in particular, a solidly designed latch on the side facing the other housing part, in particular, the front part of the housing, which protrudes from the crosspiece in axial direction, i.e. in the direction of the extension of the groove. According to the invention, such a latch can be mounted at the crosspiece and aligned in such a way that it does not project beyond the lateral walls of the groove in the locked position of the slider. In other words, in the locked position, the rigid latch is housed in the groove completely. As the result, the locking does not interfere when the connector plug is being inserted into the socket. Thus, the crosspiece does not impede, for example, the rotation of, if applicable, a bayonet ring that is mounted rotatable on the exterior circumference of the front part of the housing, which ensures the retention of the connector plug in the socket.

According to a particularly preferred variant of the invention, the crosspiece—on the side facing away from the other housing part, in particular, the front part of the housing—has a flexible, in particular, non-solid latch affixed to the crosspiece by bridges, that is designed elastically deflecting in the radial direction of the connector plug upon an application of force. In the locked position of the slider, the flexible latch abuts at a posterior end of the groove that is facing away from the other housing part, in particular, the front part of the housing. Preferable, the flexible latch is mounted and aligned at the crosspiece in such a way that upon displacing the slider into the locked position, it elastically deflects through the posterior end of the groove and snaps into the locked position in the groove. Hereby, locking the slider in the locked position (blocking) can be achieved in an easy way. Moreover, the snap lock shows the user that the slider has been installed correctly in the rear part of the housing and is secured.

In this embodiment of the invention, the slider, in the condition in which the slider is unsnapped, it can be pulled backward, i.e. pulled off in the direction that is opposite to the other housing part, from the connector plug along the guide tracks. In an unlocked position it is also not secured in the adapter of the one housing part, in particular, the rear part of the housing.

For an easier release of the flexible latch that is snapped in, the groove, according to the invention—on the side facing away from the other housing part—can have a slot extending in the center of the groove by way of extending the groove that is designed smaller than the groove in its width from one to the other lateral wall. This slot makes it possible to engage the slot with a tool and to push the flexible latch out of the groove. Then, the slider can be pulled backward and the twist-lock of the rear part of the housing and the front part of the housing can be released. The tool can be a screwdriver, for example.

A particularly preferred variant of the proposed invention provides that the slider is designed as a cover bearing onto which a socket cover can be placed when the connector plug is inserted into the socket. The shape of the bearing plate is adapted to the shape of the socket cover and can have a sealing surface in order to work together with a seal located in the socket cover. Thereby, the sealing surface of the cover bearing is primarily a mechanical protection of the seal.

In order to support the cover, the slider that is designed as cover bearing preferably has a round bearing plate on which the crosspiece and the guide elements are located on the side facing the connector plug. Preferably, the crosspiece is aligned in the direction of the diameter of the bearing plate. The two guide elements can then be arranged parallel to the crosspiece on one side of the crosspiece respectively. The outer shape of the guide elements can essentially be the segment of a circle and be adapted to the circumference of the bearing plate or be located set back opposite to such. The guide elements can be adapted to the outer shape of the circumference of the housing of the connector plug, in particular, the rear part of the housing in such a way that these abut on the outer circumference of the connector plug (in particular in the execution as cover bearing) in the locked position of the slider. In this way they additionally secure and guide the cover bearing by also supporting the guide elements on the outer shape of the cover.

For the alignment of the bearing plate, the crosspiece, together with the, if applicable, rigid latch and/or the flexible latch forms a level plane on the side opposite to the bearing plate, which is aligned aslant to the plane of the bearing plate. With this level plane, the crosspiece lies on the bottom of the groove of the front part of the housing and the rear part of the housing when the slider, respectively the cover bearing, is in its locked position. Thereby, the bearing plate is inclined to support the socket cover relative to the axial direction of the connector plug. The incline of the bearing plate is adapted to the direction of the cover plane—which corresponding to its linkage to the socket housing—shows when the connector plug is inserted into the socket and the socket cover abuts on the bearing plate of the cover bearing.

Additional advantages, features and possibilities of application of the invention also result from the following description of an exemplary embodiment and the drawing. Thereby, all features described and/or pictorially illustrated by themselves are the subject matter of the present invention, even independent of their summary in the claims or their references.

Shown are:

Figure 1:
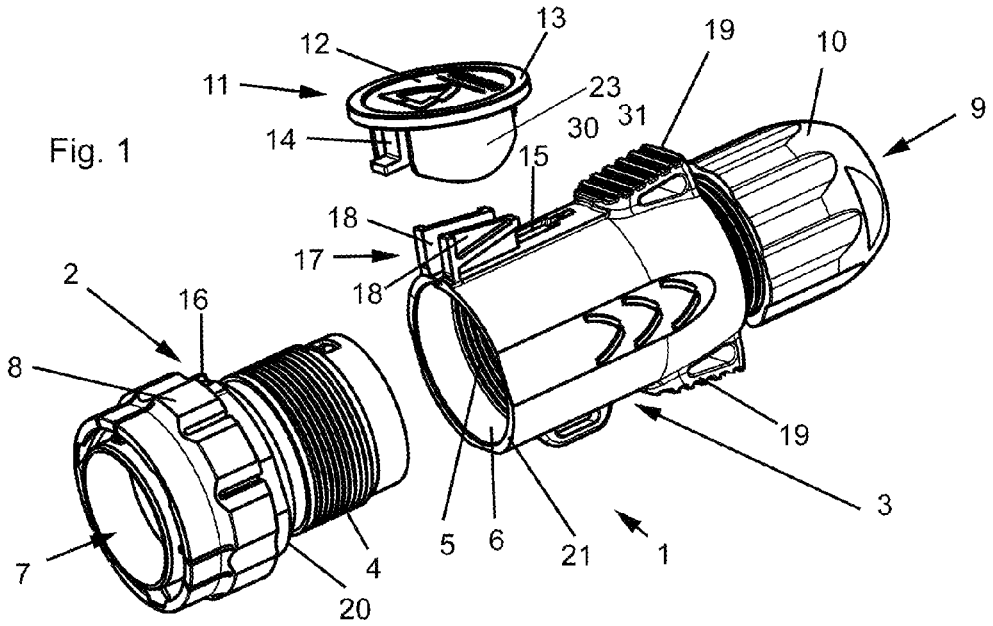
FIG. 1 shows a three-dimensional view of a preferred embodiment of the connector plug according to the invention in an exploded view of the front part of the housing, the rear part of the housing and the slider designed as cover bearing.

FIG. 1 shows a connector plug 1 according to the invention having a multipart housing that has a front part of housing 2 and a rear part of housing 3 that are screwed together and fixated by means of a thread.

The tread consists of an outer thread 4 of the front part of the housing 2 that is screwed into an inner thread 5 of the rear part of housing 3. Inner thread 5 is formed in a housing aperture 6 of the rear part of housing 3, into which the front part of housing 2 is inserted with outer thread 4 so they can be screwed together.

The front part of housing 2 forms a contact area 7 for connecting with the (not shown) socket at its side that faces away from the rear part of housing 3. In this contact area 7 contacts—not shown in the drawing—are positioned corresponding to the contact configuration in the socket. Contact area 7 of the front part of housing 2 is surrounded by a bayonet ring 8 that is located rotatable on the outer circumference of the front part of housing 2, which serves to secure connector plug 1 in the socket that is not shown. Bayonet ring 8 is rotated on the outer circumference of the front part of housing 2, in order to engage with bayonet cams in the socket.

However, connector plug 1 according to the invention is not limited to the presence of a bayonet ring to secure connector plug 1 in the socket. In general, any other securing mechanism is conceivable. The invention also relates to connector plugs that are only inserted into the socket without any further securing device.

Figure 8:
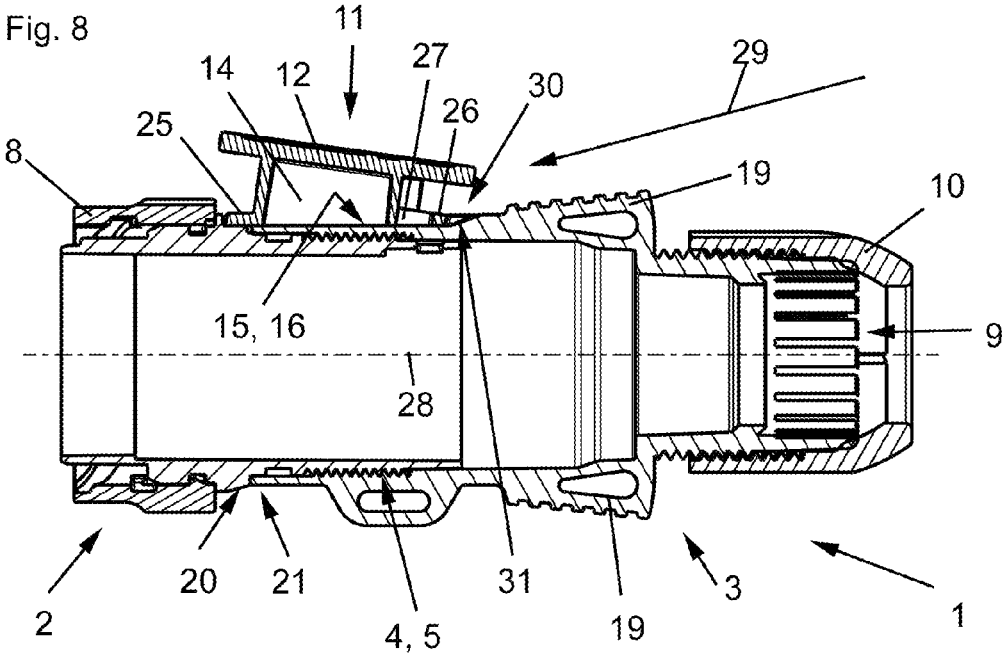
FIG. 8 shows a cross section through FIG. 3 along the line A-A of the slider corresponding to FIG. 4.

At the front part of housing 2—in axial direction opposite to the end of rear part of housing 3—a more clearly shown housing connection aperture 9 is shown in FIG. 8 for inserting a connecting line into the housing of connector plug 1 that is surrounded with a connecting cable nut 10 for seizing. By means of screwing connecting cable nut 10 tight at the rear part of housing 3, a connecting line inserted into the housing connecting aperture 9 is seized and retained in known manner. This is also not shown in further detail in the drawing.

The illustrated connector plug 1 corresponds, for example, to the ISOBUS standard that is used, in particular, in agriculture and in trucking.

In contrast to known connector plugs, in connector plug 1 that is preferred according to the invention, a slider 11 designed as a cover bearing is provided that has a bearing plate 12 onto which a cover of the socket into which connector plug 1 has been inserted can be placed in such a way that a cover seal bears on a sealing surface 13 of bearing plate 12 which protects the seal of the socket cover.

On the side of slider 11 facing the housing of connector plug 1, a crosspiece 14 is formed in the direction of the diameter of the basically formed bearing plate 12 that can be inserted into a groove 15 of the rear part of housing 3 and into a groove 16 of the front part of housing 2. Crosspiece 14 is housed in an adapter 17 that consists of two plates 18. Plates 18 are formed aligned with the lateral walls of groove 15 in the rear part of housing 3, so that crosspiece 14 extends between the lateral walls of the groove and the facing inner side surfaces of plates 18 that are aligned with the lateral walls of the groove.

The housing of slider 11 that is formed as cover bearing in adapter 17 of the rear part of housing 3 will be described in further detail below.

At the side of the rear part of housing 3 facing connecting cable nut 10, relative to the central axis of the rear part of housing 3, diametrically opposite hand grip elements 19 are provided by means of which connector plug 1 can be pulled out of the socket more easily.

Figure 2:
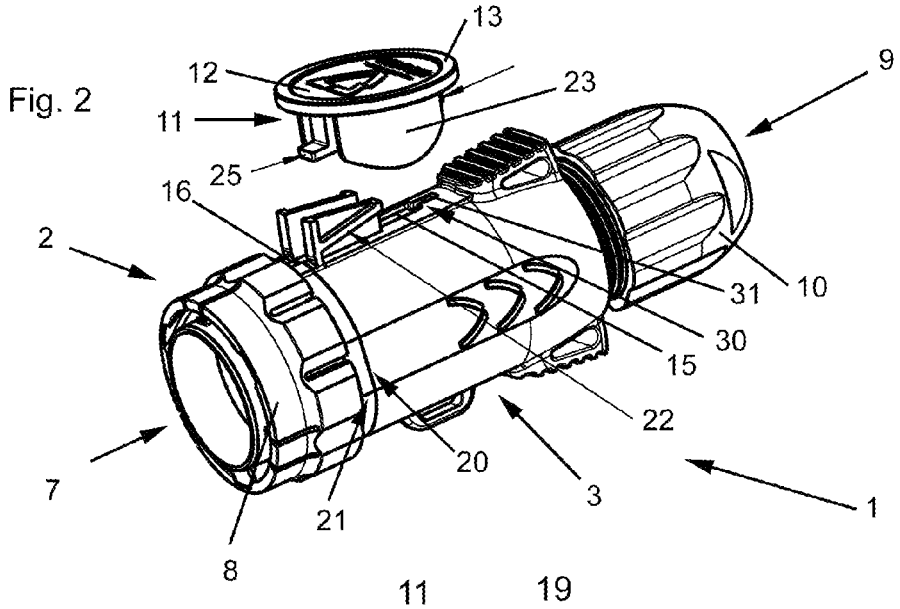
FIG. 2 shows the connector plug according to FIG. 1 with the housing screwed together.

FIG. 2 shows the connector plug 1 when it is screwed together, i.e. when the inner thread 4 of the front part of housing 2 is screwed into outer thread 5 of the rear part of housing 3. The path of screw insertion of these two housing parts is limited thereby, that at the front part of housing 2 a radially protruding edge 20 is formed that works together with edge 21 of housing aperture 6 as stop.

This stop that is formed by the radially protruding edge 20 and edge 21 of housing aperture 6 limits the path of screw insertion between the front part of housing 2 and the rear part of housing 3 in such a way that groove 15 of the rear part of housing 3 and groove 16 of the front part of housing 2 come to lie with respectively aligned lateral walls of grooves 15, 16 when the front part of housing 2 and the rear part of housing 3 are screwed together completely, i.e. are screw-fastened up to the stop. In other words, grooves 15, 16, then form a common, continuous groove.

Figure 3:
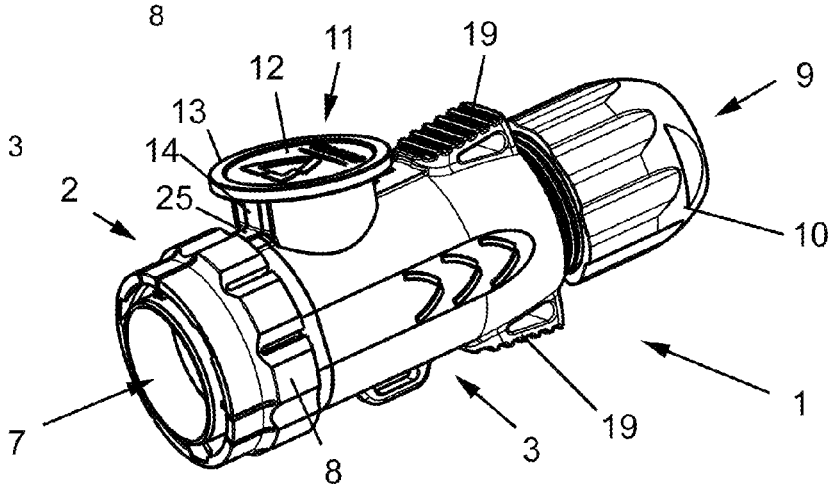
FIG. 3 shows the connector plug according to FIG. 2 with a locked slider.

Slider 11 is inserted into this groove and fixated as shown in FIG. 3. For this, at plates 18 of adapter 17 a guide track 22 is provided respectively that extends aslant on guide plate 18 and works together with one guide element 23 of slider 11 respectively. For this purpose, each guide element 23 on the inner side—not shown in FIG. 2—also has a track 24 that engages behind guide track 22 on each plate 18. Slider 11 is inserted at a slant from the rear, i.e. coming from the housing connection aperture 9 of the rear part of housing 3 with crosspiece 14 between plates 18 in such a way that tracks 24 of guide elements 23 engage behind guide tracks 22, i.e. engage between guide tracks 22 and the outer circumference of the housing of the rear part of housing 3.

Upon displacing slider 11 forward in the direction of the front part of housing 2, slider 11 is moved through guide tracks 22 along which tracks 24 slide in the direction of the front part of housing 2 and toward the housing of connector plug 1 until crosspiece 14 engages with groove 15 of the rear part of housing 3 as well as with groove 16 of the front part of housing 2.

In this position, slider 11 is blocked by a catch mechanism that will be described in further detail below so that a relative rotation of the front part of housing 2 and the rear part of housing 3 toward each other is not possible.

In this position, bearing plate 12 with sealing surface 13 is also located relative to the front part of housing 2 in such a way that a cover hinged to the socket comes to lie directly on bearing plate 12 after connector plug 1 has been inserted into the socket in such a way that sealing surface 13 abuts at a ring gasket in the cover. In the configuration shown in FIG. 3, connector plug 1 is ready for use, whereby the contact arrangement in contact area 7 of connector plug 1 and the connecting line that leads through housing connection aperture 9 are not shown.

It can be seen in FIG. 2 that crosspiece 14 has a protrusion in the form of a rigid latch 25 at the underside that is facing away from bearing plate 12 that immerses in groove 16 of the front part of housing 2 in the locked position of slider 11 shown in FIG. 3. Rigid latch 25 does not project into contact area 7 of the front part of housing 2 and does not block bayonet ring 8 in its rotation either.

In the following FIGS. 4 through 7, slider 11 that is designed as cover bearing is described in further detail in order to describe how slider 11 works together with guide tracks 22 of plates 18 in adapter 17 of the rear part of housing 3.

Figure 4:
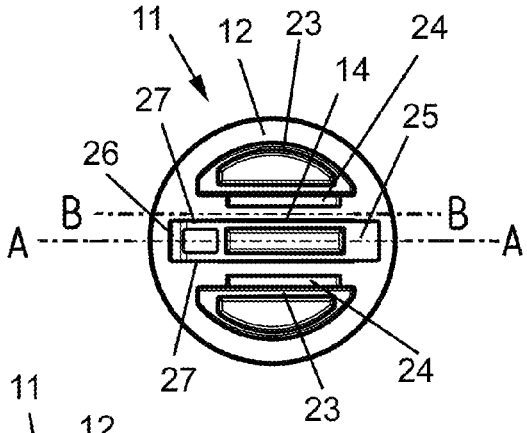
FIG. 4 shows a top view of the slider from the side of the slider facing the housing of the connector plug.

FIG. 4 shows bearing plate 12 from the below, i.e. from the side that is opposite to the bearing side of the cover of the socket. Crosspiece 14 is located the direction of the diameter of bearing plate 12 that has at its one end—in the illustration the right end—rigid latch 25 as protrusion of crosspiece 14. In the installed condition of slider 11 in the socket, it is aligned in the direction of the front part of housing 2. On the side of crosspiece 14 that is opposite to rigid latch 25, a flexible latch 26 of crosspiece 14 is formed that is connected with crosspiece 14 by means of two bridges 27. This flexible latch 26 can be moved elastically, in particular, in the direction toward bearing plate 12 due to the comparatively thin bridges 27.

Figure 5:
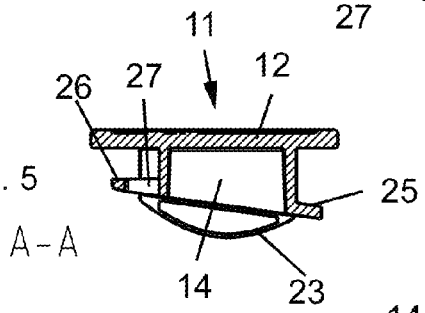
FIG. 5 shows a cross section along line A-A of FIG. 4.

This is made clear in FIG. 5, which shows a cross section along the line A-A through FIG. 4. Upon a force impinging in the direction of the arrow underneath flexible latch 26, flexible latch 26 is moved elastically in the direction of bearing plate 12. As soon as the application of a force in this direction diminishes, the flexible latch moves back again in the initial position shown in FIG. 5.

Figure 6:
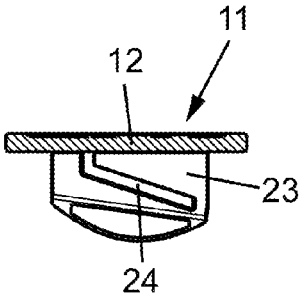
FIG. 6 shows a cross section along line B-B of FIG. 4.

FIG. 6 shows a cross section along a line B-B in FIG. 4, whereby the inner side of guide element 23 is visible in the same alignment as in cross section A-A in FIG. 5.

On the inner side of guide element 23, i.e. on the side of guide element 23 facing crosspiece 14, the previously addressed track 24 can be seen that works together with guide track 22 on plate 18 in order to—when slider 11 is inserted into adapter 17—guide slider 11 in the direction of the front part of housing 2 onto the housing of connector plug 1.

As can be seen in FIG. 5, crosspiece 14 is designed aslant with rigid latch 25 and flexible latch 26 when compared with bearing plate 12. As this crosspiece 14 comes to lie in groove 15, 16 of the rear part of housing 3 and the front part of housing 2, bearing plate 12 of slider 11 that is designed as cover bearing is aligned aslant in its locked position at the rear part of housing 3 relative to central axis 28 of connector plug 1.

Figure 7:
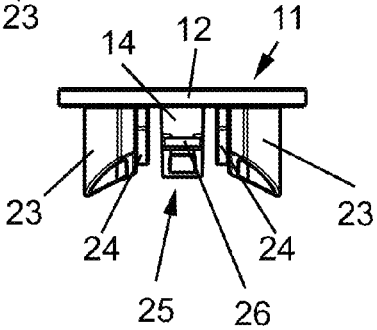
FIG. 7 shows a lateral view of the slider according to FIG. 4.

FIG. 7 shows a lateral view of slider 11 that is designed as cover bearing with bearing plate 12 in the center of which, along the direction of the diameter, crosspiece 14 is located with rigid latch 25 and flexible latch 26. On both sides of crosspiece 14 one of the guide elements 23 with track 24 is located respectively that work together with guide track 22 of one of plates 18 respectively.

FIG. 8 shows a cross section through the entire connector plug 1 corresponding to FIG. 3 along line A-A in FIG. 4 (with a slider 11 affixed at the rear part of housing 3), whereby in the interior of the housing neither the contact configuration with the contacts nor the connecting line are shown.

When slider 11 is blocked in the locked position it can be seen clearly that rigid latch 25 of crosspiece 14 engages in the common groove 15, 16 of the front part of housing 2 and the rear part of housing 3. Flexible latch 26 of crosspiece 14 is retained firmly abutting above bridges 27, at the posterior (i.e. facing away from the front part of housing 2) end of groove 15 to the rear part of housing 3 so that slider 11 in groove 15, 16 of the front part of housing 2 and the rear part of housing 3 is blocked in the locked position.

While slider 11 is being inserted from the rear into the common groove 15, 16 as indicated by the direction of insertion 29, flexible latch 26 is pushed elastically upward by the edge of housing 30 that forms the posterior end of the groove in the rear part of housing 3 until slider 11 has been advanced so far in the direction of the front part of housing 2 that flexible latch 26 snaps into groove 15.

In this configuration, slider 11 with bearing plate 12 is securely and immovably retained in connector plug 1.

For unlocking slider 11 and transitioning from a locked position into a release position in which the front part of housing 2 and the rear part of housing 3 can be rotated relative to each other, at the posterior part of groove 15 of the rear part of housing 3, i.e. at the end of groove 15 that is opposite to the front part of housing 2, a slot 31 is formed into which a tool can be inserted, for example, a screw driver in order to bend flexible latch 26 upward out of the groove in order to permit a shifting motion of slider 11 away from the front part of housing 2 and to subsequently unscrew the front part of housing 2 from the rear part of housing 3.

Thus, by means of the connector plug 1 according to the invention it is thereby reliably prevented that the front part of housing 2 and the rear part of housing 3 is unintentionally opened. An intentional unlocking of slider 11 that is designed as cover bearing is possible by means of a commercially available tool, for example, a screw driver. Because slider 11 is designed as cover bearing, slider 11 achieves a dual functionality by saving components, namely the placement and securing of the cover of a socket as well as a locking of the front part of housing 2 and the rear part of housing 3. This is even combined with an attractive design.

REFERENCE NUMBERS

1 connector plug
2 front part of the housing
3 rear part of the housing
4 outer thread of front part of the housing
5 inner thread of rear part of the housing
6 housing aperture
7 contact area
8 bayonet ring
9 housing connection aperture
10 connecting cable nut
11 slider designed as cover bearing
12 bearing plate
13 sealing surface
14 crosspiece
15 groove in the rear part of the housing
16 groove in the front part of the housing
17 adapter
18 plate
19 hand grip element
20 radially protruding edge
21 edge of the housing aperture
22 guide track
23 guide element
24 track
25 rigid latch of the crosspiece
26 flexible latch of the crosspiece
27 bridge
28 central axis
29 direction of insertion
30 edge of housing
31 slot

What is claimed is:

1. A connector plug for insertion into a socket, in particular, for connecting an attachment and/or a trailer to a vehicle, having a multipart housing comprising a front part of the housing and a rear part of the housing, whereby the front part of the housing and the rear part of the housing are affixed to each other by means of being screwed together by a thread, wherein in each of the front part of the housing and the rear part of the housing a groove is formed respectively, whereby the two grooves extend in axial direction at an outer edge circumference of the front part of the housing and the rear part of the housing and are aligned relative to each other when the front part of the housing and the rear part of the housing are screwed together completely, and that a slider can be housed by an adapter at the front part of the housing or the rear part of the housing, whereby the slider has a crosspiece that engages with the groove of the front part or the rear part of the housing and when the front part of the housing and the rear part of the housing are screwed together completely the slider can be displaced into a locked position in which the crosspiece of the slider engages with the groove of both housing parts, the rear part of the housing and the front part of the housing, and the slider in the adapter of the one housing part is blocked against a displacement and/or a rotation out of the locked position;

wherein the crosspiece has a rigid latch on the side facing the other housing part that protrudes from crosspiece in axial direction and is located and aligned at the crosspiece in such a way that the crosspiece does not project beyond the lateral walls of groove in the locked position of the slider.

2. The connector plug as recited in claim 1, wherein, the adapter for the slider is formed at the rear part of the housing.

3. The connector plug as recited in claim 2, wherein the adapter has two plates that protrude upward opposite to each other parallel to the lateral walls of groove from the exterior circumference of the rear part of the housing, and that on the two plates guide tracks are provided that work together with the guide elements of the slider and prevent that the slider falls off in radial direction from the rear part of the housing.

4. The connector plug as recited in claim 3, wherein the two plates are located laterally aligned with the lateral walls of the groove, whereby each plate is aligned with one lateral wall of groove.

5. The connector plug as recited in claim 3, wherein the guide tracks are located aslant at the plates, so that they have a larger distance to the outer circumference of the rear part of the housing at their one end than at their other end.

6. The connector plug as recited in claim 5, wherein the distance of the guide tracks to the outer circumference of the rear part of the housing at the edge of the plates that are facing the front part of the housing is smaller than at the end of plates facing away from the front part of the housing.

7. The connector plug as recited in claim 1, wherein the crosspiece has a flexible latch on the side facing away from the other housing part that is designed elastically deflecting upon an application of force in the radial direction of connector plug and which abuts at a posterior end of the groove that is facing away from the other housing part in the locked position of slider.

8. The connector plug as recited in claim 7, wherein the groove has a slot extending in elongation of the groove in the center of the groove on the side facing away from the other housing part that is formed smaller than the groove.

9. The connector plug as recited in claim 1, wherein the slider is designed as cover bearing onto which a socket cover can be placed when the connector plug is inserted into the socket.

10. The connector plug as recited in claim 9, wherein the crosspiece forms a level plane on the side opposite to a bearing plate of the cover bearing which is aligned aslant to the plane of the bearing plate.

* * * * *